US006830304B2

(12) United States Patent
Suzuki et al.

(10) Patent No.: US 6,830,304 B2
(45) Date of Patent: Dec. 14, 2004

(54) IMAGE-FORMING APPARATUS AND CUTTING METHOD OF SHEET MEMBER IN THE SAME

(75) Inventors: Ryo Suzuki, Tokyo (JP); Tomohiro Ishitsu, Tokyo (JP); Kazumi Kobayashi, Kanagawa (JP); Takeshi Miura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/418,092

(22) Filed: Apr. 18, 2003

(65) Prior Publication Data

US 2003/0210290 A1 Nov. 13, 2003

(30) Foreign Application Priority Data

May 10, 2002 (JP) ..... 2002-135481

(51) Int. Cl.[7] ..... B41J 29/38; B41J 2/01
(52) U.S. Cl. ..... 347/9; 347/101; 347/104
(58) Field of Search ..... 347/9, 101, 104

(56) References Cited

U.S. PATENT DOCUMENTS

2001/0055044 A1 * 12/2001 Matsumoto et al. ..... 347/35

FOREIGN PATENT DOCUMENTS

JP 6-198989 7/1994 ..... B41J/11/70

* cited by examiner

*Primary Examiner*—Stephen D. Meier
*Assistant Examiner*—Alfred Dudding
(74) *Attorney, Agent, or Firm*—Fitzpatrick, Cella, Harper & Scinto

(57) ABSTRACT

An image-forming apparatus, using a printing head for ejecting ink drops on a sheet member, includes a conveying unit for conveying the sheet member, a cutting member for cutting the sheet member, and a carriage member having the printing head and the cutting member mounted thereon and scanning in a direction that intersects the direction of conveying the sheet member by the conveying unit. Dust generated by cutting the sheet member is prevented from scattering by cutting a cutting site with the cutting member after printing a predetermined pattern along the cutting site of the sheet member with the printing head.

20 Claims, 9 Drawing Sheets

IMAGE-FORMING APPARATUS AND CUTTING METHOD OF SHEET MEMBER IN THE SAME

BACKGROUND OF THE INVENTION

1. Field of the Invention

The present invention relates to an image-forming apparatus having a cutting device for cutting a sheet printing medium and a cutting method for cutting a sheet member in the image-forming apparatus.

2. Description of the Related Art

In an image-forming apparatus, such as a plotter or a printer, using a roll or a large-sized sheet printing medium, after it is printed thereon, the sheet printing medium is cut into an arbitrary size as needed. Examples of such cutting devices include a device having a carriage and a cutter unit engaged with the carriage as disclosed in Japanese Patent Laid-Open No. 6-198989 and a device having a blade movable in the cutting direction independently from the carriage.

Examples of such a large-sized sheet printing media include, in addition to ordinary paper, coated paper, in which a surface of the paper is coated with an ink-penetrative material such as calcium carbonate and alumina, cloth coated with a similar material, and a polyester film (these will be referred to below as sheet members).

However, a conventional cutting device of the image-forming apparatus has problems in cutting a sheet member as follows.

That is, by the cutting impact, dust is produced in the case of paper and coating dust is generated in the case of coated paper. In a film, a surface layer may be delaminated therefrom so as to fly in all directions. If these fine particles or fine pieces (referred to below as fine particles) adhere on a printing region of the sheet member, degradation of an image may result. If the fine particles attach to a nozzle of an ink-ejection head, ink non-ejection or a malfunction of the head may result.

SUMMARY OF THE INVENTION

In view of the situation described above, the present invention has been made and it is an object thereof to provide an image-forming apparatus capable of preventing fine particles due to cutting of a sheet member.

Further objects, features and advantages of the present invention will become apparent from the following description of the preferred embodiments with reference to the attached drawings.

DESCRIPTION OF THE PREFERRED EMBODIMENTS

Embodiments according to the present invention will be described below with reference to the drawings.

(First Embodiment)

Figure 1:
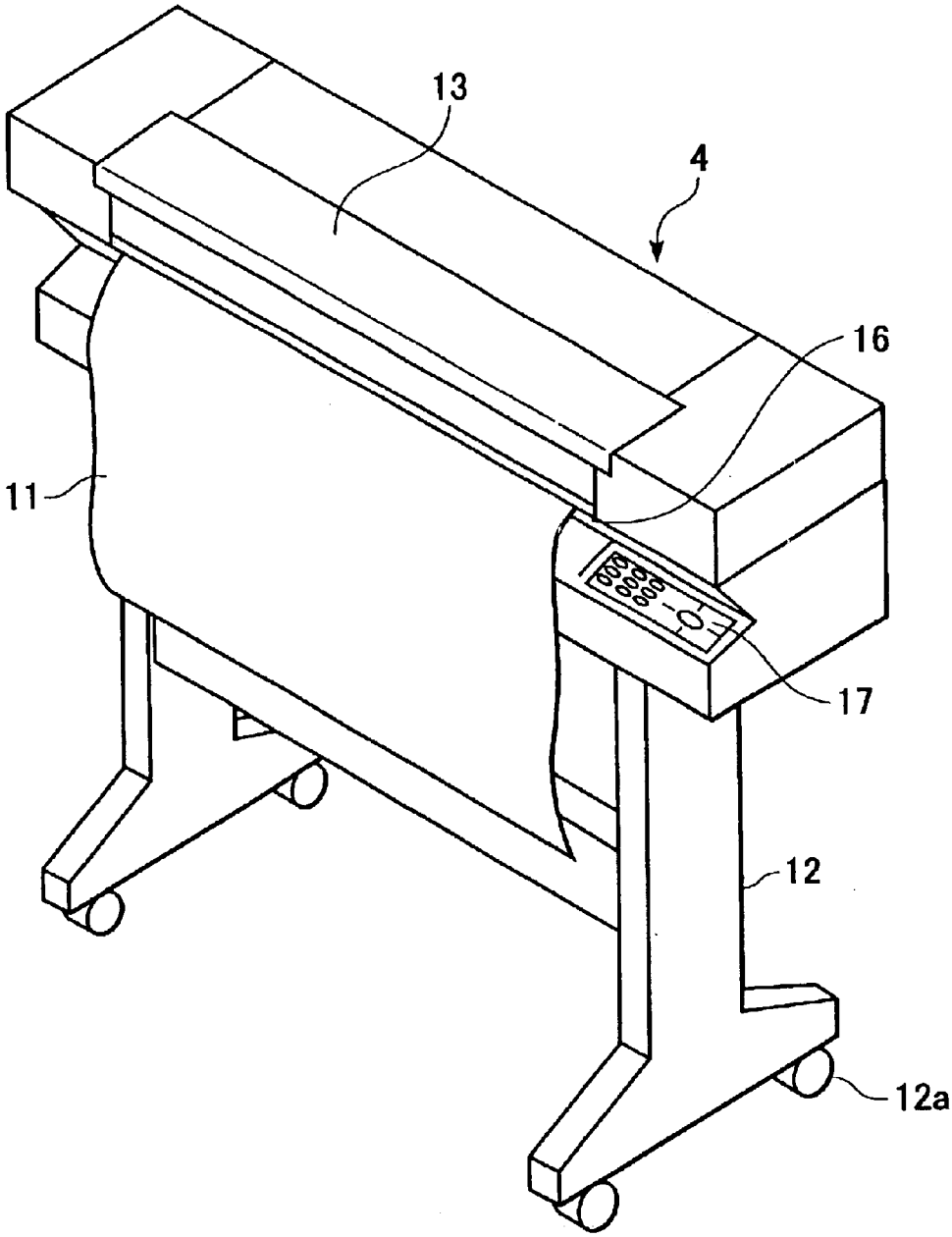
FIG. 1 is an external view of an inkjet-printing plotter as an example of an image-forming apparatus according to the present invention.

A first embodiment of the present invention will be described with reference to FIGS. 1 to 5. FIG. 1 shows an inkjet-printing large-sized color plotter 4 as an example of an image-forming apparatus incorporating the present invention.

The plotter 4 is fixed on a stand 12 with castors 12*a*. The plotter 4 is provided with an operating panel 17 to be operated by a user. Various switches provided on the operating panel 17 prompt the user for inputting information of the kind of a sheet member, an on/off of printing on a cutting site, and the switching between an on-line/off-line. A sheet member 11, such as printing paper wound-up in a roll (roll paper) furnished inside or large-sized printing paper inserted into a loading slot, is conveyed inside the plotter 4 based on the input command from the operation panel 17, so that color images are printed on the sheet member 11 with a printing head 35 based on the data given from an external computer. The sheet member 11 having images printed thereon is discharged from an outlet 16 disposed in the upper front of the plotter 4. The plotter 4 is provided with a cover 13 for covering the inside of the plotter 4.

Figure 2:
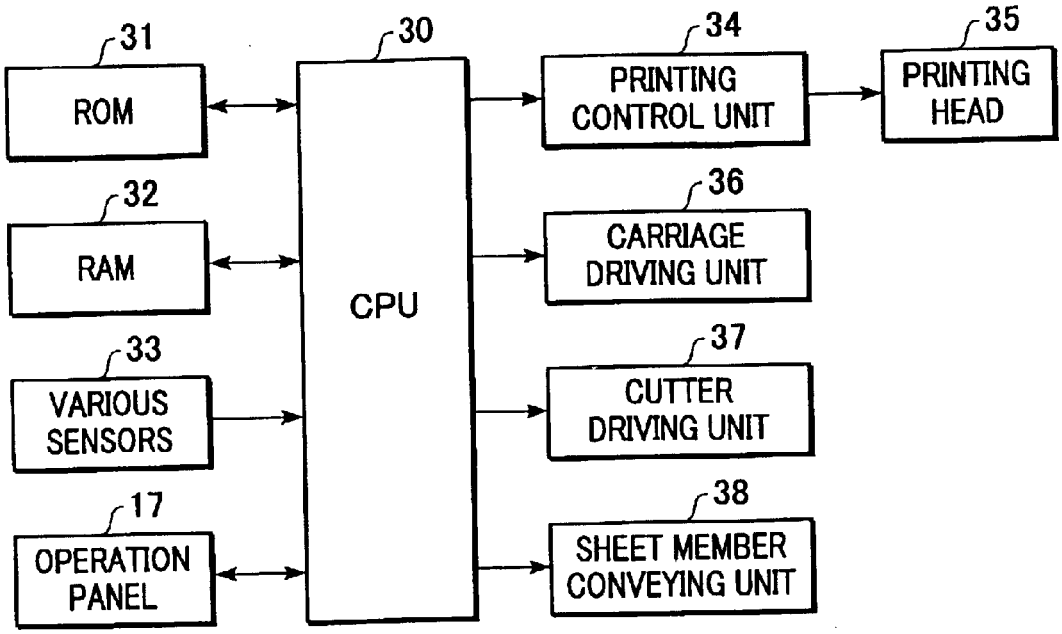
FIG. 2 is a block diagram showing an example of a hardware configuration of the image-forming apparatus shown in FIG. 1.

FIG. 2 shows an outline of a hardware control configuration of the plotter 4. The overall operation of the plotter 4 is controlled by a CPU 30. ROM 31 is a non-volatile memory storing data such as control programs to be executed by the CPU 30 and various parameters. RAM 32 is a memory for supplying temporary-data storage and work areas available to the CPU 30. Various sensors 33 are for detecting various kinds of information necessary for operating the plotter 4. A printing control unit 34 drives the printing head 35 under the control of the CPU 30. A carriage driving unit 36 controls the operation of a carriage 6 under the control of the CPU 30. A cutter driving unit 37 controls the operation of a cutter unit 7 (mainly paying in and out a cutter blade 3 which will be described later) under the control of the CPU 30. A sheet-member conveying unit 38 controls the conveying of the sheet member 11 under the control of the CPU 30. The operation panel 17 is provided with a display in addition to the input section mentioned above. The operation of the image-forming apparatus according to the present invention, which will be described later, is executed by controlling each control unit and each driving unit with the CPU 30 according to the control programs stored in the ROM 31.

Figure 9:
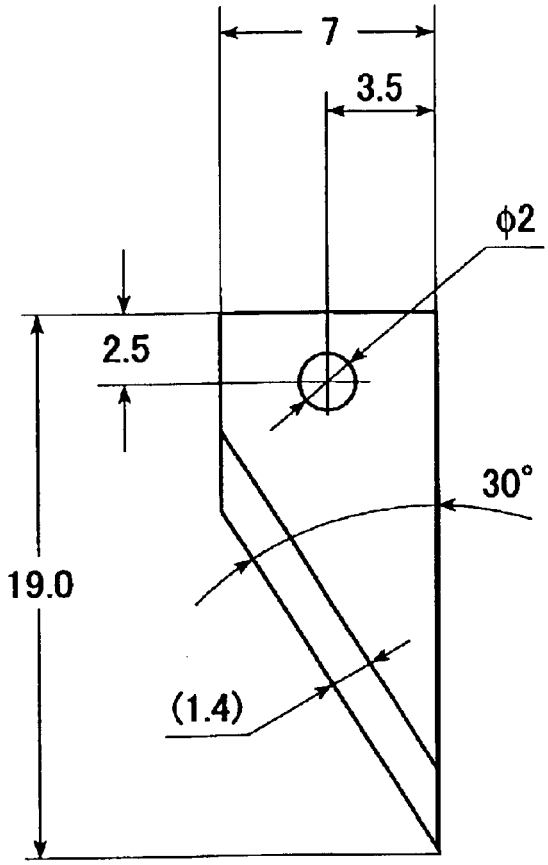
FIG. 9 is a drawing showing a shape of a cutting blade.
Figure 10:
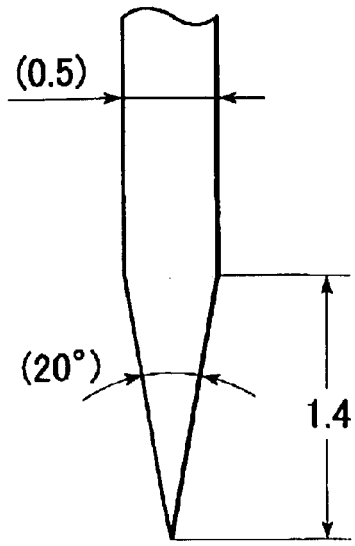
FIG. 10 is a drawing showing a sectional shape of the cutting blade.

The structure and operation of the cutter unit 7 will be described with reference to FIG. 3 The cutter unit 7 according to the embodiment and having the printing head 35 (not shown) mounted thereon is mounted on the carriage 6, and the cutter unit 7 is moved in a direction 23 intersecting the direction vector conveying the sheet member 11 using a motor and a belt (both not shown) which are moving means of the carriage 6. The cutter unit 7 is provided with the cutter blade 3 capable of being protruded/housed FIG. 9 is an external view of the shape of the cutter blade 3 In the thickness of the cutter blade 3 (the size in a direction perpendicular to the plane of the figure), the maximum thickness is about 0.5 mm. The cutter blade 3 is provided with a blade edge formed at the tip and having a length of about 1.4 mm and an edge angle of about 20°. FIG. 10 is a drawing illustrating the sectional shape of the cutter blade 3. As is understood from this drawing, the edge of the cutter blade 3 with a maximum thickness of about 0.5 mm is in a root portion of the inclined surface. The direction of this thickness agrees with the conveying direction of the sheet member 11 when the cutter blade 3 is attached to the cutter unit 7 On a platen 5, there is provided a cutter groove 21 formed along the direction 23 so as to receive the edge of the cutter blade 3 in a state protruded from the cutter unit 7.

Heretofore, after the image printing on the sheet member 11 is finished, the position to be cut of the sheet member 11 is conveyed to the position of the cutting groove 21, and then the cutter blade 3 housed in the cutter unit 7 is protruded so as to cut the sheet member 11 by moving the carriage 6, i.e., the cutter blade 3, along the cutter groove 21. Thereafter, the cutter blade 3 is housed into the cutter unit 7 again.

Whereas according to the present invention, prior to cutting the sheet member 11, at a position to be cut by the cutter blade 3 (simply referred to as a cutting site), i.e., on a cutting site scheduled for the passing of the cutter blade 3, a predetermined image pattern is printed with ink (referred to as cutting-site printing). The cutting procedure of the sheet member 11 according to the embodiment will be described with reference to FIG. 4.

Figure 5:
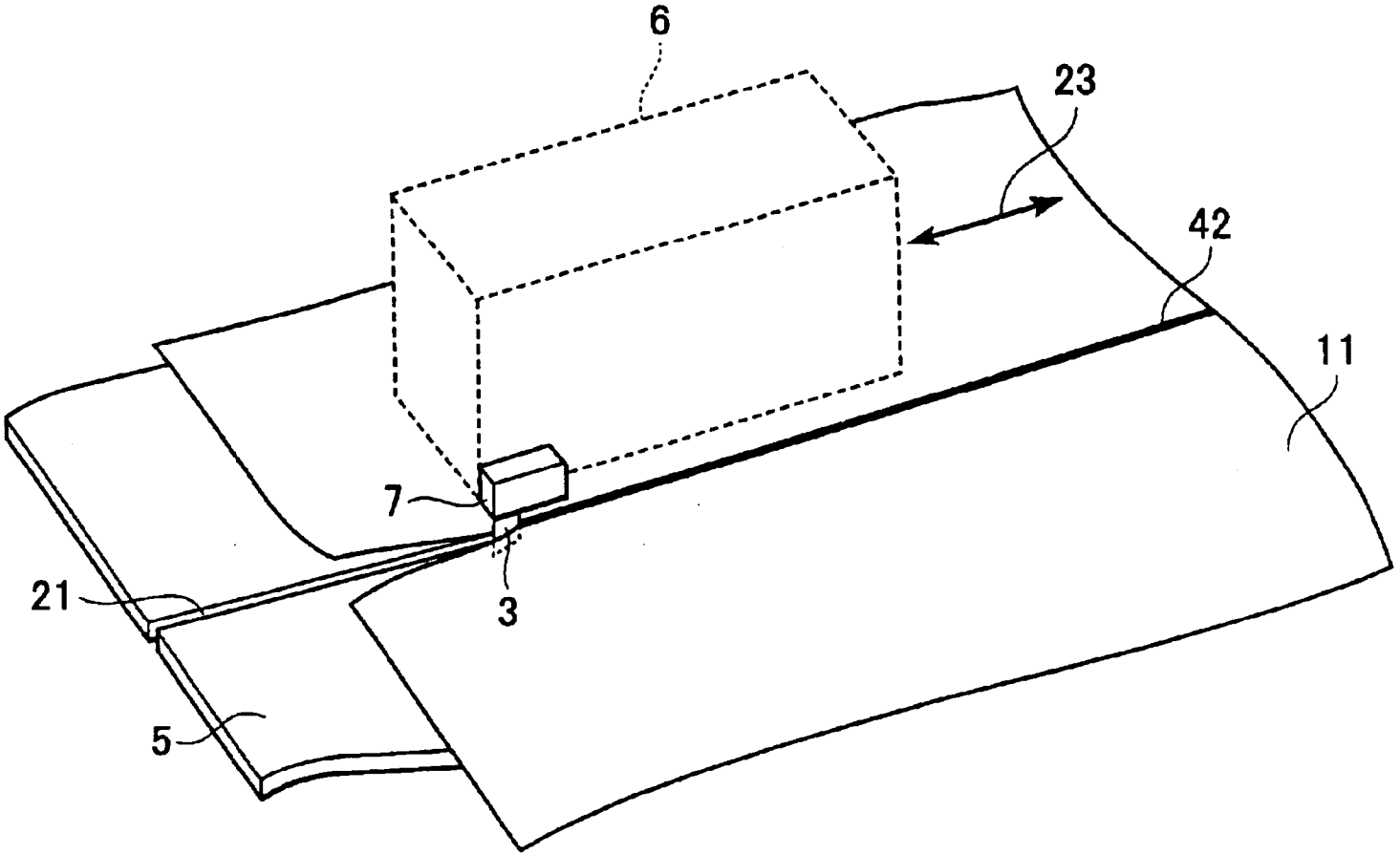
FIG. 5 is a drawing showing the cutting operation of a sheet member in the image-forming apparatus according to the present invention.

According to the embodiment, it can be switched in advance by a user commanding it from the operating panel 17 whether the cutting-site printing is performed. Then, after printing, on cutting the sheet member 11, it is checked whether the cutting-site printing is established (S11). If it is not established, the procedure proceeds to Step S14, which will be described later. If it is established, the cutting site of the sheet member 11 is conveyed to a printing position (position of the printing head) (S12). Then, the cutting site is printed in a predetermined printing mode (S13). An example of the printing mode is shown in FIG. 5, in which a linear image pattern 42 with a width of about 3 mm (the size in the conveying direction of the sheet member 11) is printed on substantially the entire region of the cutting site of the sheet member 11. Obviously, the width of the image pattern 42 is not limited to 3 mm. Although it is not mandatory, it is preferable that the width of the image pattern 42 be larger than the thickness of the cutter blade 3. By doing so, even if the image pattern 42 is displaced from the actual cutting site to some degree, the cutting site is securely wetted with ink sufficiently, preventing dust from being spread.

The linear image pattern 42 for the cutting-site printing along the cutting site is not necessarily a solid line, but it may be a broken line. The predetermined image pattern 42 may also be linearly arranged characters or symbols. Corresponding to environmental conditions such as temperature, the ink ejection amount, i.e., the printing duty, may also be changed. After all, it is sufficient that the substantially entire range of the cutting site be wetted. The switching between these printing modes may be performed from the operation panel 17, for example.

After the cutting-site printing at Step S13, the cutting-site of the sheet member 11 is conveyed to a position opposing the cutter blade 3 (S14), and then at this position, the cutter blade 3 is allowed to protrude toward the sheet member 11 by operating the cutter unit 7, while by moving the carriage 6 simultaneously, the sheet member 11 is cut at the cutting-site (S15).

In such a manner, by the cutting-site printing, the cutting-site of the sheet member 11 is penetrated with ink to dampen the sheet. Then, the cutting-site of the sheet member 11 is cut. The cutting-site printing has been described to perform it after color images are printed on the sheet member 11; alternatively, the image pattern 42 may be printed on the cutting-site prior to the color image printing. In this case, the printing mode may be selected so that the cutting-site print has not been dried at the time of the cutting operation.

(Second Embodiment)

A second embodiment according to the present invention will be described with reference to FIG. 6. The second embodiment relates to the cutting-site printing corresponding to the kind of the sheet member. Characteristics of the sheet member 11 depend on its kind. For example, there are sheet members with so-called large or small stiffness. There may also be sheet members having various thicknesses. If the cutting-site is printed with the same image pattern 42 regardless of such kinds and thicknesses of the sheet member 11, the state of cutting thereafter performed by the cutter blade 3 may be different. For example, if a thin-paper sheet member 11 is printed with the image pattern 42 with too high density (high duty), the stiffness of the sheet member 11 is reduced so that an edge of the sheet member 11 may be folded by the cutter blade 3 when the cutter blade 3 protrudes over the sheet member 11. If a drying period is provided for preventing such cutting malfunction, the printing throughput is reduced.

Then, according to the second embodiment, at least one of image patterns and printing densities to be printed on the cutting-site are changed corresponding to the kind or thickness of the sheet member 11. Thereby, for a member with small stiffness such as a thin sheet member, the cutting-site printing with high duty can be avoided, enabling to prevent the edge of the sheet member from being folded on cutting. A thick sheet member 11 is enabled to be sufficiently damp on the cutting-site by performing the cutting-site printing with high duty thereon. As kinds of the image patterns, in addition to the solid line and the broken line mentioned above, the line width can be changed not only along one whole line, but also partially, i.e., the line width of the sheet leading-edge being different from the other portion of the same line. In addition, the change in the printing density means the change in the printing duty.

Figure 6:
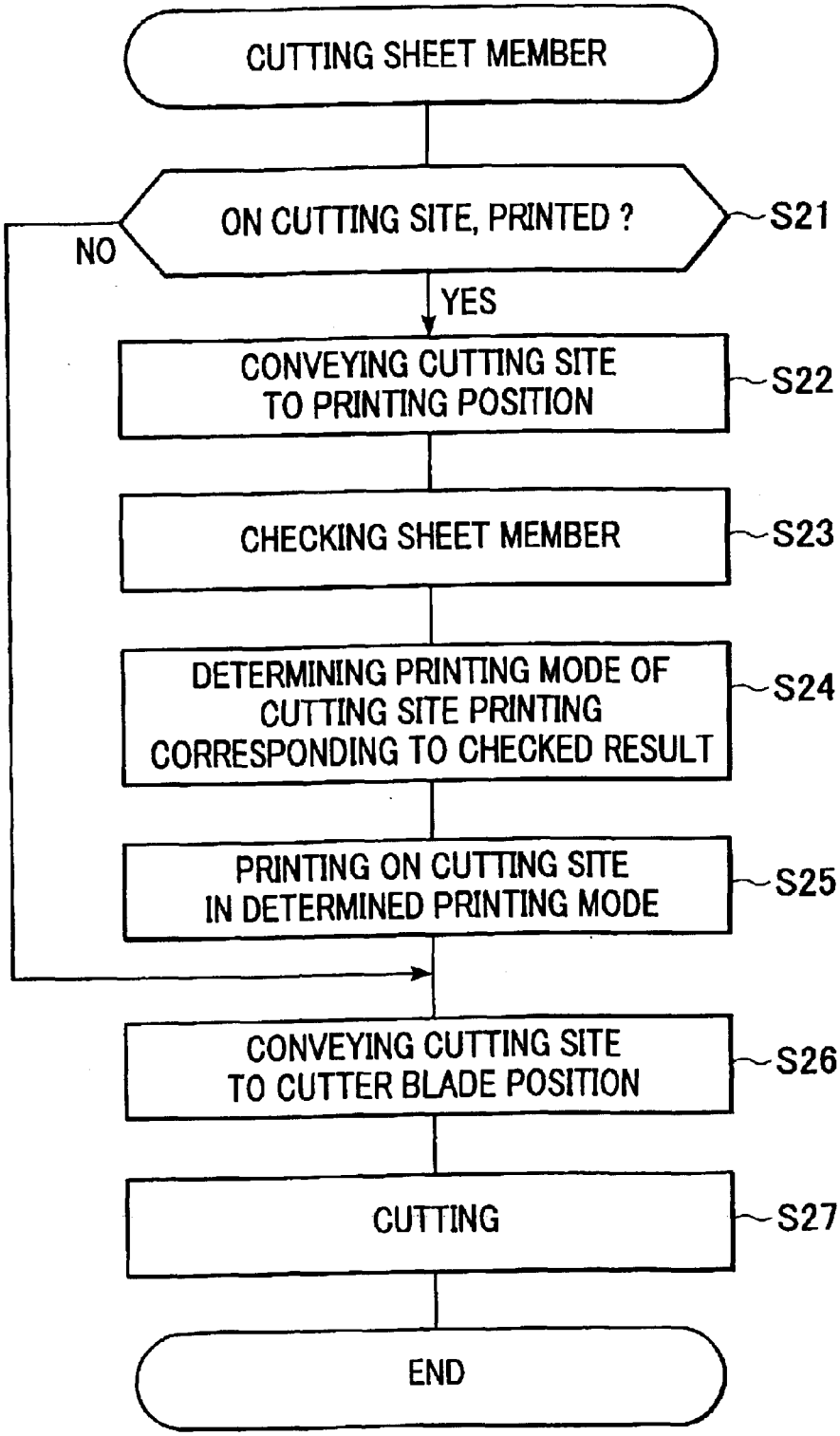
FIG. 6 is a flowchart for illustrating an example of the cutting operation of a sheet member in an image-forming apparatus according to a second embodiment of the present invention.

FIG. 6 shows an example of the cutting process of the sheet member 11 according to the second embodiment. On cutting the sheet member 11, in the same way as mentioned above, it is checked whether the cutting-site printing is established (S21). If it is not established, the procedure proceeds to Step S26, which will be described later. If it is established, the cutting site of the sheet member 11 is conveyed to a printing position (position of the printing head) (S22). Then, at least one of the kind and thickness of the sheet member 11 mounted at present is checked (S23). The information for these procedures is obtained from a user who inputs it into the operation panel 17 and the detected result by sensors for detecting the kind and thickness of the sheet member 11, which are provided in the various sensors 33. Then, corresponding to results checked in Step S23, the printing mode of the cutting-site printing, such as the kind of the printing pattern and the printing density, is determined (S24). This determination of the printing mode may be automatically performed based on the detected information concerning the kind and thickness of the sheet member 11 obtained by the system at Step S23, or may be performed manually by a user. Then, the cutting-site is printed in the printing mode determined at Step S24 (S25). After the cutting-site printing at Step S25, the cutting-site of the sheet member 11 is conveyed to a position opposing the cutter blade 3 (S26), and at this position, the cutter blade 3 is allowed to protrude toward the sheet member 11 by operating the cutter unit 7, while by moving the carriage 6 simultaneously, the sheet member 11 is cut at the cutting-site (S27).

As an application of this process, Step S23 and Step S24 are moved to the beginning of this process flow. That is, first Step S23 is performed and then Step S24 is performed. The case where the cutting-site is not printed is included in the printing-mode results determined at Step S24. Next, it is determined whether the cutting-site printing is performed or not based on results obtained at Step S24 (S21). If it is determined not to print, the procedure proceeds to Step S26, and if it is determined to print, the process may proceed in the order of Step S22 to Step S25. In this case, by only the information of the kind of the sheet member 11, it can be determined whether the cutting-site printing is performed, and also if it is determined to print, the printing mode thereof can be determined. Therefore, a user need not input anything concerning the cutting-site printing. Also, only by inputting the information of the kind of the sheet member 11, the cutting suitable for the sheet member 11 can be executed.

(Third Embodiment)

Figure 7:
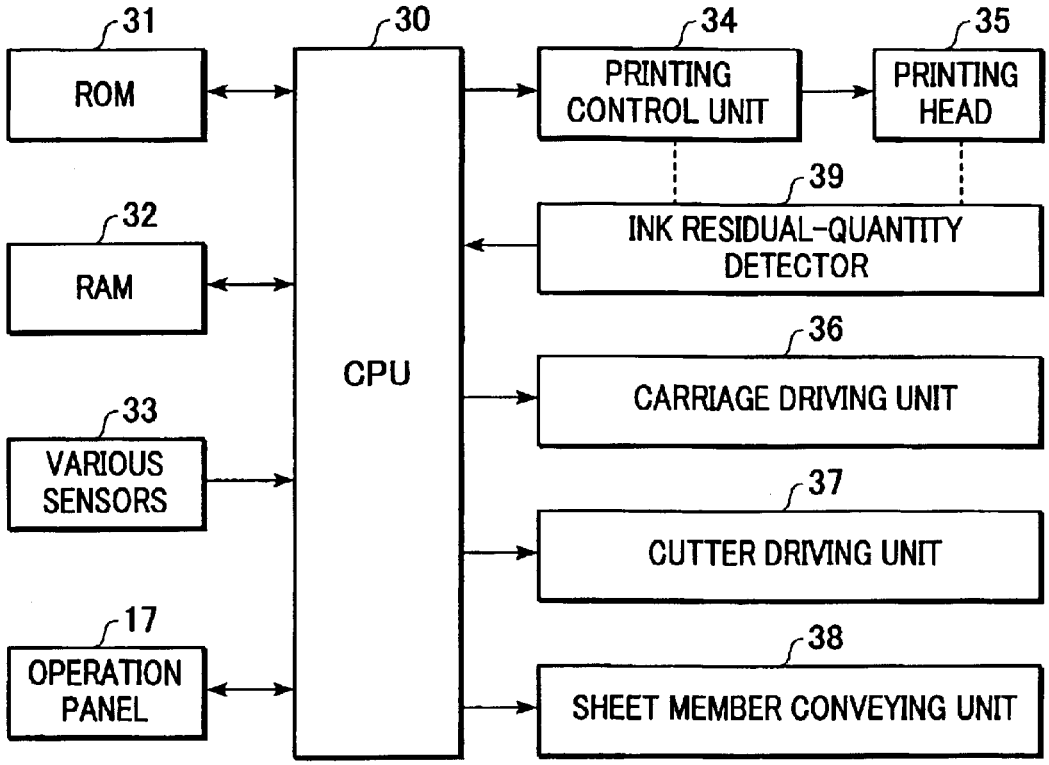
FIG. 7 is a block diagram showing an example of a hardware configuration used in an image-forming apparatus according to a third embodiment of the present invention.

A third embodiment according to the present invention will be described with reference to FIGS. 7 and 8. The third embodiment relates to the selection of ink used in the cutting-site printing Generally, a plurality of colors of ink are provided in a color image-forming apparatus, so that printing can be selectively performed with each color. As shown in the block diagram of FIG. 7, an ink residual-quantity detector 39 may be provided for each ink tank or ink cartridge of each color. The cutting-site printing mentioned above consumes ink as a use other than the use for ordinarily scheduled printing. Then, according to the third embodiment, the cutting-site printing is performed using the ink having the maximum residual quantity. The quantity of each kind of ink can be thereby evened. Also, replenishing of ink of small residual-quantity is prevented from being accelerated by further using the ink for the cutting-site printing.

Figure 8:
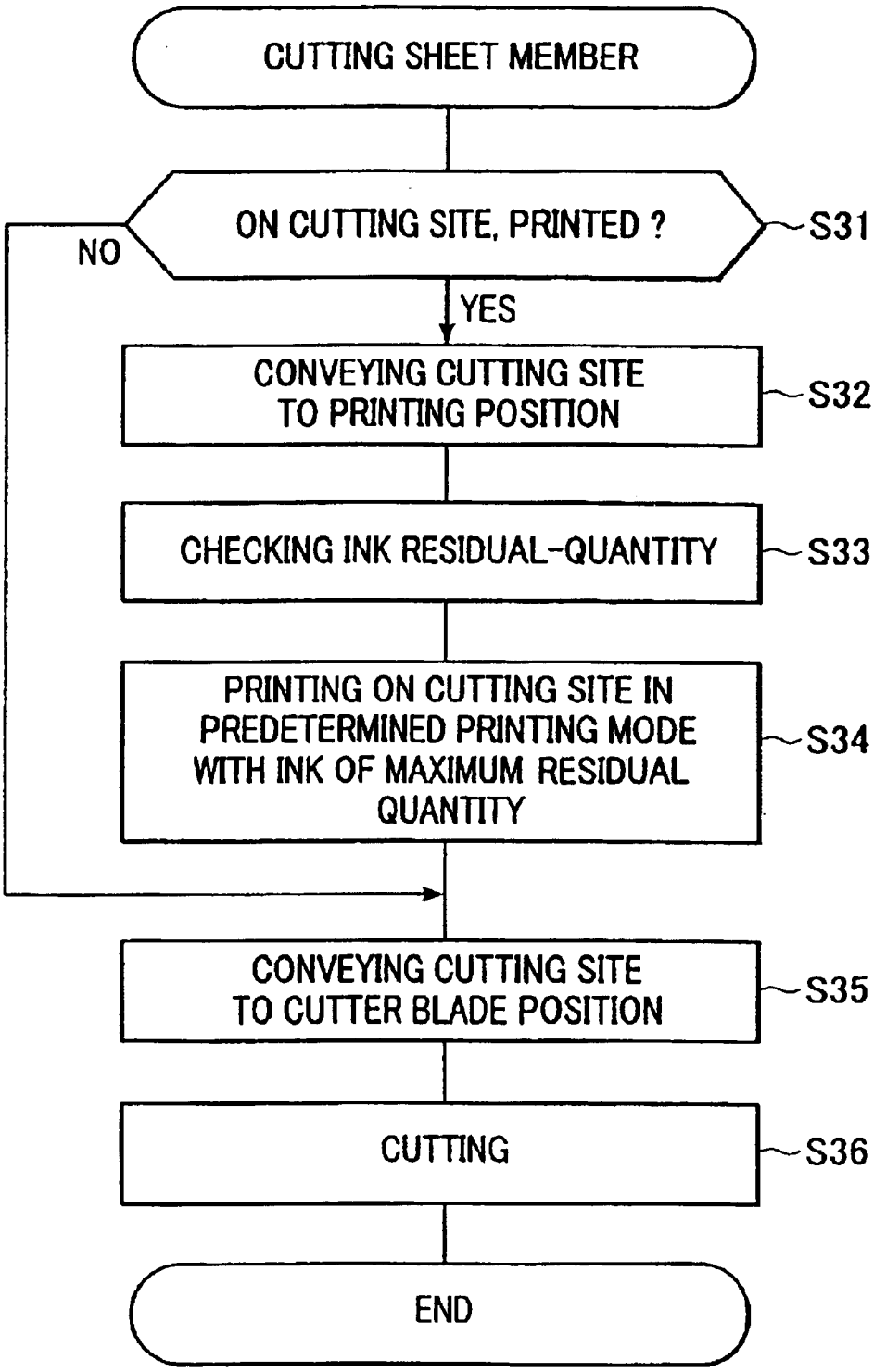
FIG. 8 is a flowchart for illustrating an example of the cutting operation of a sheet member in an image-forming apparatus according to the third embodiment of the present invention.

FIG. 8 shows an example of the cutting process of the sheet member according to the third embodiment In the same way as in the first embodiment, on the cutting the sheet member 11 it is checked first whether the cutting-site printing is established (S31). If it is not established the procedure proceeds to Step S35 which will be described later. If it is established the cutting site of the sheet member 11 is conveyed to a printing position (position of the printing head) (S32). Then the residual quantity of each kind of ink is checked by the ink residual-quantity detector 39 (S33). Next the cutting-site is printed in a predetermined printing mode with the ink having the maximum residual quantity resultant from checking at Step S33 (S34). The predetermined printing mode at this time may be fixed or variable depending on the system or a user as mentioned above. After the cutting-site printing at step S34 the cutting-site of the sheet member 11 is conveyed to a position opposing the cutter blade 3 (S35), and at that position the cutting-site of the sheet member 11 is cut by operating the cutter unit 7 and simultaneously moving the carriage 6 (S36).

The image pattern printed on the cutting-site remains at edges of the sheet member 11 even after the cutting. Therefore the color of the ink used for the cutting-site printing may be selected by a user. Also, instead of using ink for printing means for ejecting liquid, preferably transparent liquid for exclusive use in the cutting-site printing on the cutting-site may be provided. In this case the image pattern produced by the cutting-site printing can be obscured.

The first embodiment and the second embodiment may be combined with each other. Thereby both the advantages obtained by the first and second embodiments can be expected. Similarly the combinations may be adopted between the first and third embodiments the second and third embodiments and further between the first to third embodiments. The entire effects of the embodiments combined therewith can be acquired.

As described above, according to the embodiments, by performing the cutting-site printing prior to cutting the sheet member, an image-forming apparatus can be provided that is capable of confining fine particles, such as dust, coating dust, and fine pieces of a film surface, which would be generated upon cutting, with liquid such as ink so as to prevent these from scattering.

According to the embodiments, by preventing fine particles, which would be generated upon cutting the sheet member, from adhering on a printing region of the sheet member, an image-recording apparatus capable of preventing image degradation can be provided.

According to the embodiments, by preventing fine particles, which would be generated upon cutting the sheet member, from adhering to a printing head, an image-recording apparatus capable of preventing the printing head from non-ejecting or malfunctioning can be provided.

According to the embodiments, by performing the cutting-site printing corresponding to the kind of the sheet member, an image-forming apparatus can be provided that is capable of preventing a problem that an edge of the sheet member is folded upon cutting the sheet member because of the cutting-site printing with excessive printing density.

According to the embodiments, by performing the cutting-site printing corresponding to the kind of the sheet member, an image-forming apparatus can be provided that is capable of preventing the reduction in throughput because the cutting-site printing is performed with excessive printing density requiring a long drying period.

According to the embodiments, since the cutting-site is printed with the largest residual quantity of ink, an image-forming apparatus can be provided, which reduces the effect of use of ink for purposes other than printing.

While the present invention has been described with reference to what are presently considered to be the preferred embodiments it is to be understood that the invention is not limited to the disclosed embodiments. On the contrary the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-forming apparatus comprising:

a printing head for ejecting ink drops on a sheet member;

conveying means for conveying the sheet member;

a cutting member for cutting the sheet member;

a carriage member having the printing head and the cutting member mounted thereon and scanning in a direction that intersects the direction of conveying the sheet member by the conveying means; and controlling means for controlling the image-forming apparatus such that a cutting site of the sheet member is conveyed by the conveying means to a position opposing the printing head, the printing head prints along the cutting site in a predetermined pattern, and the cutting site of the sheet member having the predetermined pattern printed thereon is cut by the cutting member.

2. An apparatus according to claim 1, wherein the controlling means may increase the size of a printing region of the cutting-site printing in the predetermined pattern in the conveying direction larger than the root thickness of the blade inclined surface of the cutting member.

3. An apparatus according to claim 2, further comprising:

acquiring means for acquiring a kind of the sheet member, and switching means for switching between execution of the cutting-site printing and non-execution thereof corresponding to the information of the sheet member kind acquired by the acquiring means, wherein the controlling means performs the cutting-site printing corresponding to the result switched by the switching means.

4. An apparatus according to claim 3, wherein the switching means switches at least one of a printing pattern and a printing density of the cutting-site printing corresponding to the information of the sheet member kind acquired by the acquiring means.

5. An apparatus according to claim 3, further comprising an operation unit to be operated by an operator, wherein the information of the sheet member kind to be acquired by the acquiring means is inputted from the operation unit.

6. An apparatus according to claim 3, further comprising detecting means disposed on a conveying path of the sheet member for detecting a kind of the sheet member, wherein the information of the sheet member kind to be acquired by the acquiring means is obtained by the detecting means.

7. An apparatus according to claim 3, further comprising:

a plurality of colors of ink; and residual quantity detecting means for detecting the residual quantity of each of the plurality of colors of ink, wherein the controlling means switches the colors of the ink used for the cutting-site printing corresponding to the result of the ink residual quantity detected by the residual quantity detecting means.

8. An apparatus according to claim 5, further comprising:

a plurality of colors of ink; and residual quantity detecting means for detecting the residual quantity of each of the plurality of colors of ink, wherein the controlling means switches the colors of the ink used for the cutting-site printing corresponding to the result of the ink residual quantity detected by the residual quantity detecting means.

9. An apparatus according to claim 2, further comprising:

a plurality of colors of ink; and residual quantity detecting means for detecting the residual quantity of each of the plurality of colors of ink, wherein the controlling means switches the colors of the ink used for the cutting-site printing corresponding to the result of the ink residual quantity detected by the residual quantity detecting means.

10. An apparatus according to claim 1, further comprising:

acquiring means for acquiring a kind of the sheet member; and switching means for switching between execution of the cutting-site printing and non-execution thereof corresponding to the information of the sheet member kind acquired by the acquiring means, wherein the controlling means performs the cutting-site printing corresponding to the result switched by the switching means.

11. An apparatus according to claim 10, wherein the switching means switches at least one of a printing pattern and a printing density of the cutting-site printing corresponding to the information of the sheet member kind acquired by the acquiring means.

12. An apparatus according to claim 10, further comprising an operation unit to be operated by an operator, wherein the information of the sheet member kind to be acquired by the acquiring means is inputted from the operation unit.

13. An apparatus according to claim 12, further comprising:

a plurality of colors of ink; and residual quantity detecting means for detecting the residual quantity of each of the plurality of colors of ink, wherein the controlling means switches the colors of the ink used for the cutting-site printing corresponding to the result of the ink residual quantity detected by the residual quantity detecting means.

14. An apparatus according to claim 10, further comprising detecting means disposed on a conveying path of the sheet member for detecting a kind of the sheet member, wherein the information of the sheet member kind to be acquired by the acquiring means is obtained by the detecting means.

15. An apparatus according to claim 10, further comprising:

a plurality of colors of ink; and residual quantity detecting means for detecting the residual quantity of each of the plurality of colors of ink, wherein the controlling means switches the color of the ink used for the cutting-site printing corresponding to the result of the ink residual quantity detected by the residual quantity detecting means.

16. An apparatus according to claim 1, further comprising:

a plurality of colors of ink; and residual quantity detecting means for detecting the residual quantity of each of the plurality of colors of ink, wherein the controlling means switches the colors of the ink used for the cutting-site printing corresponding to the result of the ink residual quantity detected by the residual quantity detecting means.

17. A method for cutting a sheet member in an image-forming apparatus, said method comprising the steps of:

conveying the sheet member into the image-forming apparatus;

conveying a cutting site of the sheet member to a position opposing a printing head;

cutting-site printing a predetermined pattern along the cutting site of the sheet member with the printing head;

conveying the cutting site of the sheet member having the predetermined pattern printed thereon to a position opposing a cutting member; and cutting through the predetermined pattern at the cutting site of the sheet member having the predetermined pattern printed thereon with the cutting member.

18. An image-forming apparatus, which uses a printing head for ejecting ink drops on a sheet member, comprising:

conveying means for conveying the sheet member;

a cutting member for cutting the sheet member; and controlling means for controlling such that a cutting site of the sheet member is conveyed by the conveying means to a position opposing the printing head, the printing head prints a predetermined pattern along the cutting site, the cutting site having the predetermined pattern printed thereon is conveyed by the conveying means to a position opposing the cutting member, and the sheet member is cut by the cutting member through the cutting site having the predetermined pattern printed thereon.

19. An apparatus according to claim 18, further comprising:

acquiring means for acquiring a kind of the sheet member; and switching means for switching between execution of cutting-site printing and non-execution thereof corresponding to the information about the kind of the sheet member acquired by the acquiring means, wherein the controlling means performs the cutting-site printing corresponding to the result switched by the switching means.

20. An apparatus according to claim 19, further comprising an operation unit to be operated by an operator, wherein the information about the kind of the sheet member to be acquired by the acquiring means is inputted from the operation unit.

* * * * *

UNITED STATES PATENT AND TRADEMARK OFFICE

CERTIFICATE OF CORRECTION

PATENT NO. : 6,830,304 B2
DATED : December 14, 2004
INVENTOR(S) : Suzuki et al.

Figure 3:
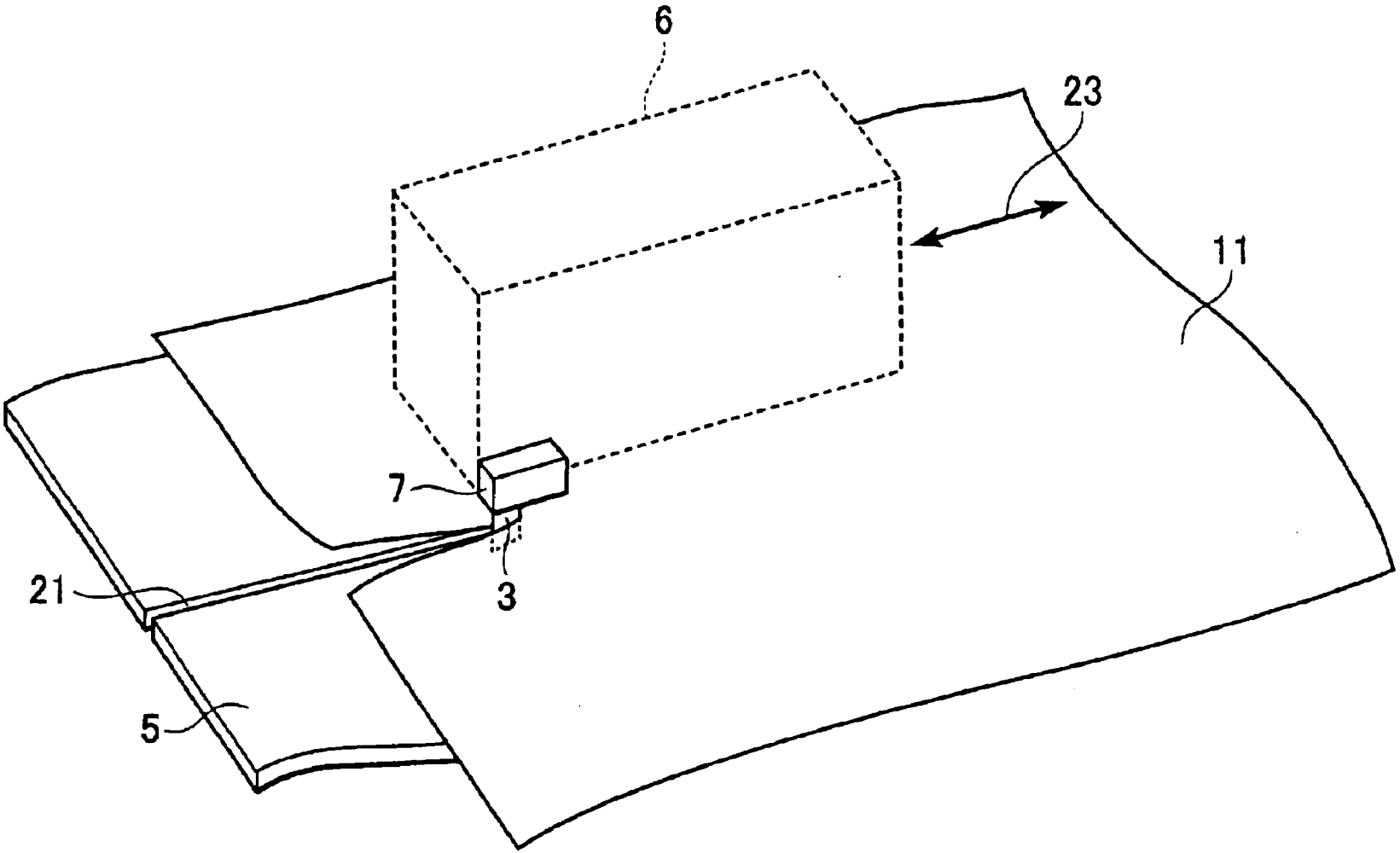
FIG. 3 is a drawing showing a structure around a carriage of the image-forming apparatus shown in FIG. 1 including a cutter unit.
Figure 4:
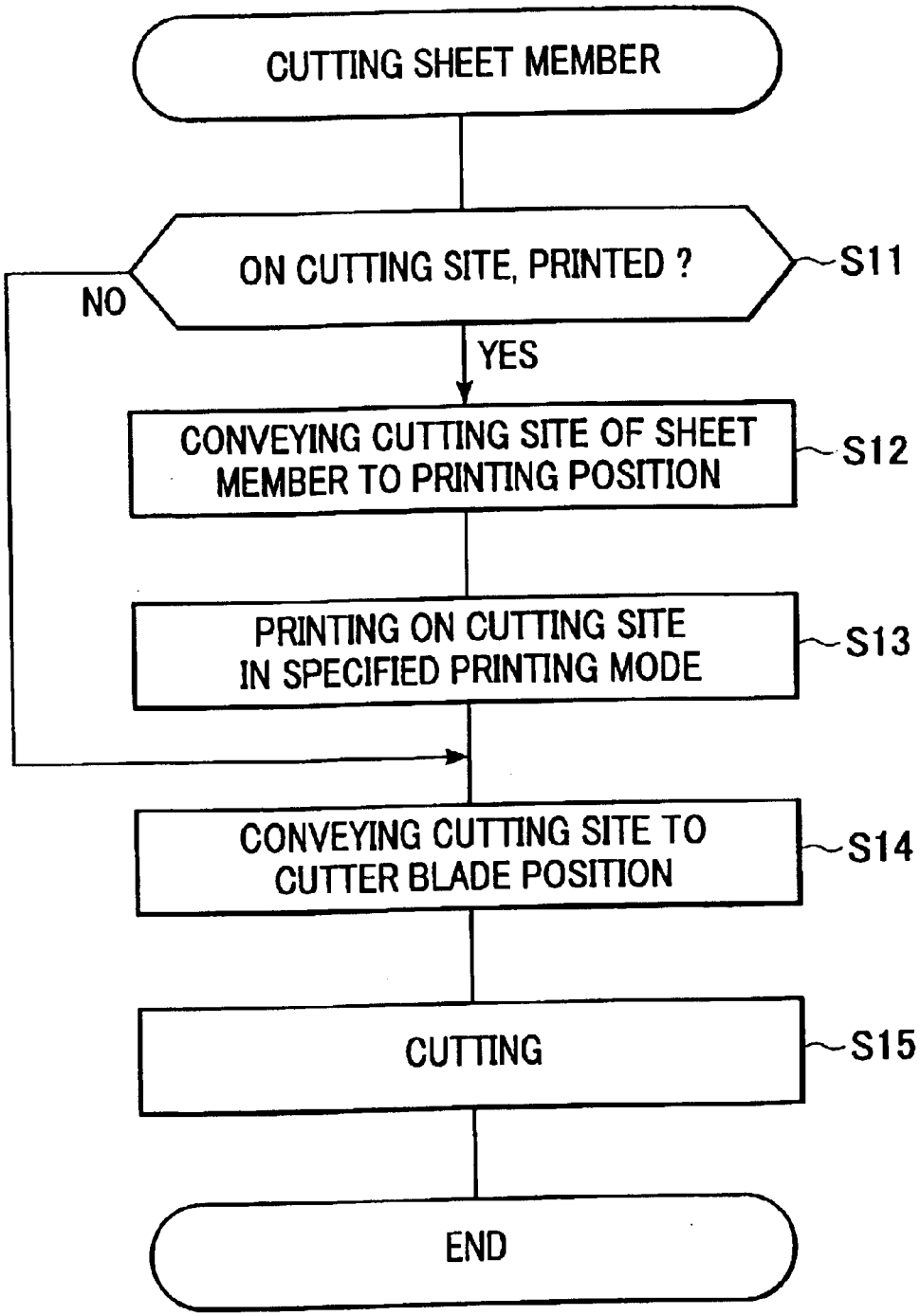
FIG. 4 is a flowchart for illustrating an example of the cutting operation of a sheet member in an image-forming apparatus according to a first embodiment of the present invention.

It is certified that error appears in the above-identified patent and that said Letters Patent is hereby corrected as shown below:

Column 3,
Line 2, "FIG. 3" should read -- FIG. 3. --.
Line 9, "protruded/housed" should read -- protruded/housed. --.
Line 10, "blade 3" should read -- blade 3. --.
Line 22, "unit 7" should read -- unit 7. --.

Column 5,
Line 40, "printing" should read -- printing. --.
Line 55, "embodiment" should read -- embodiment. --.

Signed and Sealed this

Thirty-first Day of May, 2005

JON W. DUDAS
*Director of the United States Patent and Trademark Office*